US006645023B2

(12) United States Patent
Saito et al.

(10) Patent No.: US 6,645,023 B2
(45) Date of Patent: Nov. 11, 2003

(54) OUTBOARD MOTOR ELECTRONIC PART UNIT

(75) Inventors: Yasushi Saito, Utsunomiya (JP); Ryosuke Kamata, Shioya-gun (JP); Takamasa Kezuka, Utsunomiya (JP); Akifumi Fujima, Asaka (JP); Takao Kashima, Hidaka (JP); Ryuichi Kimata, Yoshikawa (JP)

(73) Assignees: Keihin Corporation, Tokyo (JP); Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/157,124

(22) Filed: May 30, 2002

(65) Prior Publication Data

US 2003/0064640 A1 Apr. 3, 2003

(30) Foreign Application Priority Data

Oct. 1, 2001 (JP) ..... P2001-305738

(51) Int. Cl.[7] ..... B63H 20/32
(52) U.S. Cl. ..... 440/77
(58) Field of Search ..... 440/77

(56) References Cited

U.S. PATENT DOCUMENTS 4,050,093 A * 9/1977 Crall et al. ..... 361/692
4,632,662 A * 12/1986 Handa ..... 440/52

* cited by examiner

*Primary Examiner*—Jesus D. Sotelo
(74) *Attorney, Agent, or Firm*—Arent Fox Kintner Plotkin & Kahn, PLLC

(57) ABSTRACT

An outboard motor electronic part unit provided between an engine for a boat and a cover covering the engine, comprises a case which is attached to the engine or the cover and is provided along a space formed between the engine and the cover; and a circuit board equipped with a connector which is housed and fixed in the case, wherein an inclined surface in which a height thereof is large near the connector and small near a distal portion far from the connector, is provided in the case.

2 Claims, 4 Drawing Sheets

OUTBOARD MOTOR ELECTRONIC PART UNIT

BACKGROUND OF THE INVENTION

1. Field of the Invention

The present invention relates to an outboard motor electronic part unit.

2. Description of Related Art

A conventional outboard motor is sometimes provided with a V-type engine. An embodiment is explained with reference to FIGS. 6 and 7. As shown in FIG. 6, outboard motor 1 is detachably mounted on a board (not shown) via attaching bracket 2. As shown in FIG. 7, engine 3 is covered with cover 4 which is formed in a cross-sectional tapered shape tapering to the rear side from the front side along the shape of engine 3.

A side surface of engine 3 has attached thereto electronic part unit 5 which is formed by arranging electronic control parts of engine 3 into a unit and has a rectangular parallelepiped shape.

However, in the above conventional art, in order to prevent interference with the inner surface of the rear part of cover 4 with a square part of the rear part of electronic part unit 5, electronic part unit 5 is required has its attachment position adjusted or cover 4 is required to be molded a slightly larger. Therefore, there have been problems in that the attachment position of electronic part unit 5 is considerably limited and cover 4 is enlarged.

For example, if electronic part unit 5 is not attached, it is sufficient to form cover 4 which has a size shown by a dash-dot—dot line in FIG. 7. If electronic part unit 5 is attached, since cover 4 has a cross-sectional tapered shape, cover 4 is required to be enlarged to the size shown by a continuous line in FIG. 7 in order to avoid cover 4 interfering with the square part of the rear part of electronic part unit 5.

On the other hand, if the height of electronic part unit 5 can be reduced, in other words, if the length of the part protruding from engine 3 can be shortened, cover 4 is not required to be enlarged. However, since discrete parts which require a certain height are used on the circuit board in electronic part unit 5, the height of electronic part unit 5 cannot simply be reduced.

Furthermore, the above electronic part unit 5 is filled with resin for waterproofing; however, the weight of the resin causes an increase in the weight of the outboard motor, and this is a problem.

BRIEF SUMMARY OF THE INVENTION

To solve the above problems, an object of the present invention is to provide an outboard motor electronic part unit which is able to be attached to a desired place of the side surface of engine, and is reduce in size and is lighter.

A first aspect of the present invention is to provide an outboard motor electronic part unit provided between an engine for a boat and a cover covering the engine, comprising a case which is attached to the engine or the cover and is provided along a space formed between the engine and the cover; and a circuit board equipped with a connector which is housed and fixed in the case, wherein an inclined surface in which a height thereof is great at the connector and low at a distal portion far from the connector, is provided in the case.

For example, the engine may be referred to as engine 3, the cover may be referred to as cover 6, the outboard motor electronic part unit may be referred to as outboard motor electronic part unit 8, the space may be referred to as space 7, the case may be referred to as case 9, the connector may be referred to as connector 10, 11, or 12, the circuit board may be referred to as circuit board 13, and the inclined surface may be referred to as inclined surface 93*a*, which are described in embodiments which are explained below.

According to the above structure, since the case has a small height by providing the inclined surface, the space occupied by the case can be small. Furthermore, the case can be provided in the space formed between the engine and the cover without interfering with the cover. Therefore, the limitation of the mounting position of the case to the engine is decreased and the outboard motor electronic part unit is smaller and lighter.

Furthermore, in the outboard motor electronic part unit, the circuit board may be mounted with parts having a large height among circuit parts near the connector and with parts having a lesser height among circuit parts in the distal direction from the connector so as to be housed in the case having the inclined surface.

For example, the parts having a great height are referred to as discrete parts 15 and 16 which are described in the embodiments which are explained below.

According to the above structure, since the case has a reduced height by providing the inclined surface, the space occupied by the case can be small. Circuit parts can be mounted along the inclined surface in the case, in which parts having a large height among circuit parts are mounted near the connector and with parts having lesser heights among circuit parts in the distal direction from the connector.

DETAILED DESCRIPTION OF THE INVENTION

An embodiment of the present invention will be explained with reference to FIGS. 1 to 5 with reference to FIG. 6.

Figure 1:
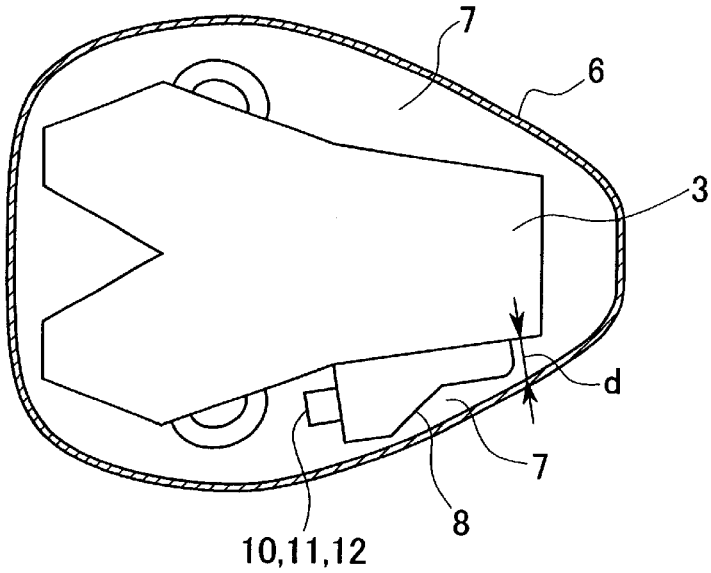
FIG. 1 is a cross-sectional view taken on line A—A in FIG. 6 of an embodiment of the present invention.

As shown in FIG. 1, V-type engine 3 for an outboard motor is equipped with cover 6 via a bracket (not shown) so as to cover engine 3 with cover 6.

In order to cover engine 3, cover 6 is formed into a tapered shape having a planar cross section so as to be wide at a cylinder portion placed at the front side and narrow at the rear side. Therefore, space 7 is formed between engine 3 and cover 6, that is, is formed at both sides of the rear portion, wherein space 7 is formed into a tapered shape having planar cross section.

Outboard motor electronic part unit 8 to be mounted on engine 3 is provided in space 7.

Figure 2:
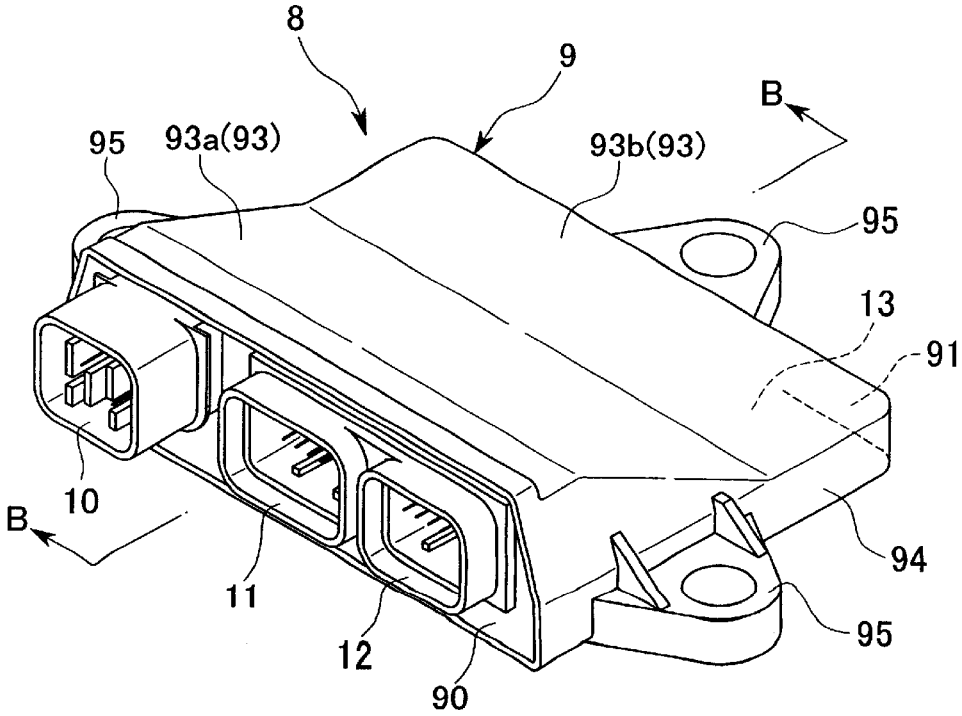
FIG. 2 is a perspective view of an embodiment of the present invention.
Figure 3:
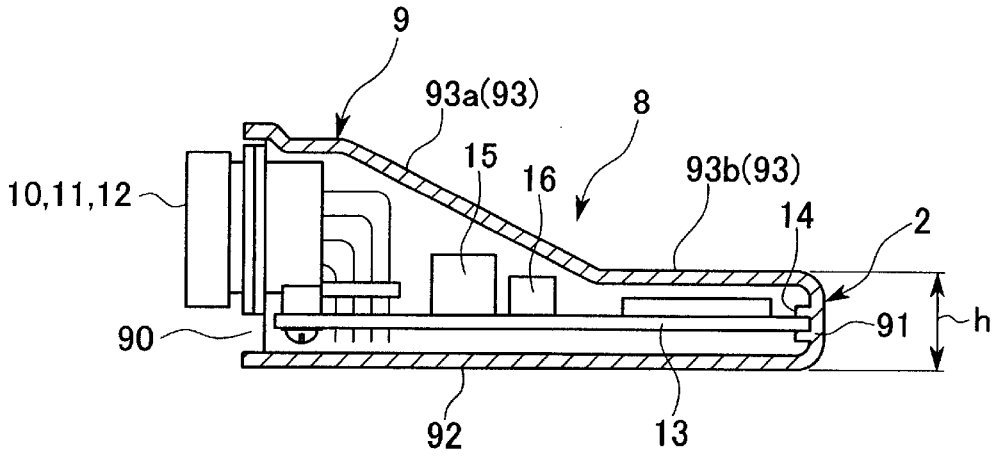
FIG. 3 is a cross-sectional view taken on line B—B in FIG. 2 of an embodiment of the present invention.

As shown in FIGS. 2 and 3, outboard motor electronic part unit 8 is equipped with case 9 and circuit board 13.

Case 9 is mounted on engine 3 and is formed into a tapered shape having a planar cross section so as to be provided in space 7 formed between engine 3 and cover 6.

One side of case 9, which is corresponding to connectors 10, 11, and 12 to be explained below, is formed as opening 90, and the other side is closed. That is, opening 90 is formed by planar bottom surface 92, upper surface 93, and two side surfaces 94 so as to be open. Upper surface 93 is formed of inclined surface 93*a* which is high at opening 90 and low at bottom surface 92, and planar surface 93*b* which is formed continuously in parallel to bottom surface 92. Case 9 is formed into a tapered shape when shown from a side surface side. Furthermore, as shown in FIG. 2, brackets 95 to be mounted on engine 3 are equipped on each side surface 94 and the other side surface 95 of case 9.

The height h between the upper surface of planar surface 93*b* of upper surface 93 and the lower surface of bottom surface 92 is less than the interval d at the portion corresponding to the above cover 6 and engine 3.

Circuit board 13 is set by inserting it into engaging portion 14 which is provided inside the other side 91 in case 9. Circuit board 13 is equipped with connectors 10, 11, and 12, and adjacently discrete parts 15 and 16 having a relatively large height, such as a power transistor, power zener diode, condenser, and the like, so as to be high at a front portion and low at a rear portion.

Figure 4:
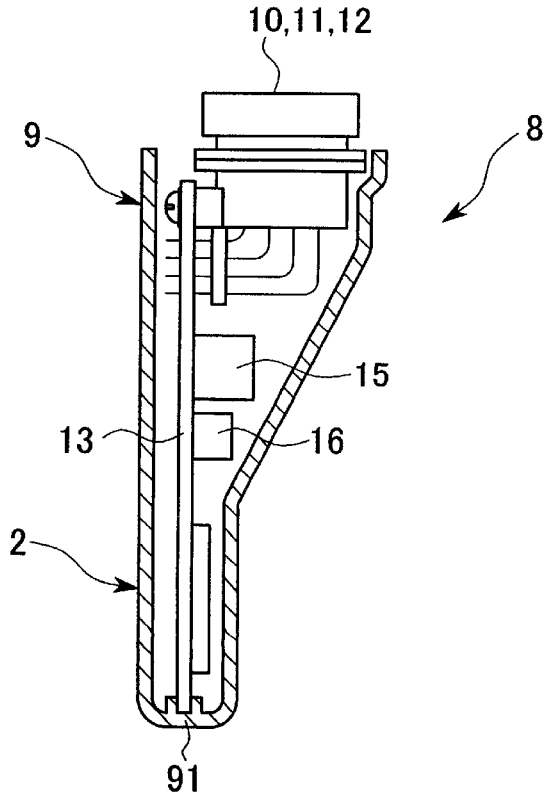
FIG. 4 is a cross-sectional view showing an embodiment of the present invention.
Figure 5:
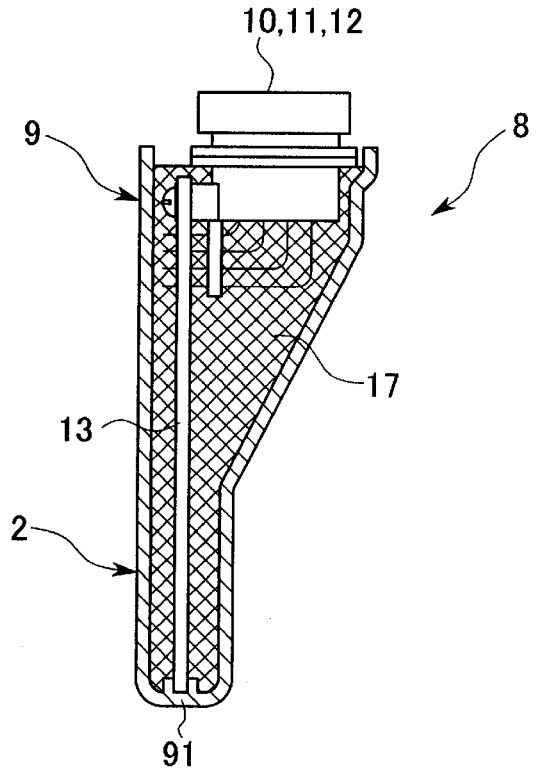
FIG. 5 is a cross-sectional view showing an embodiment of the present invention.
Figure 6:
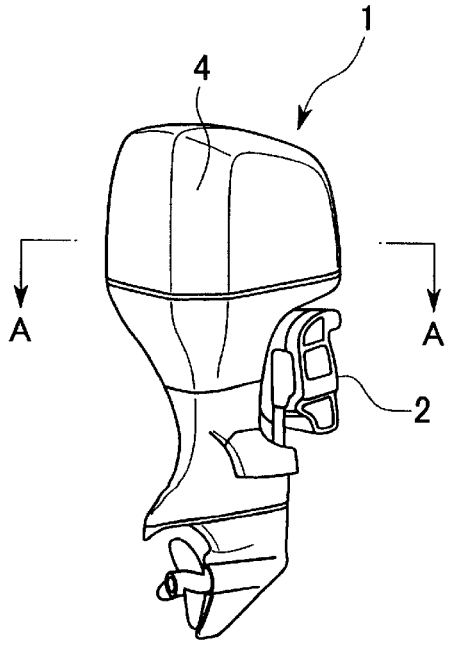
FIG. 6 is a perspective view of an embodiment of the present invention or of a conventional example.
Figure 7:
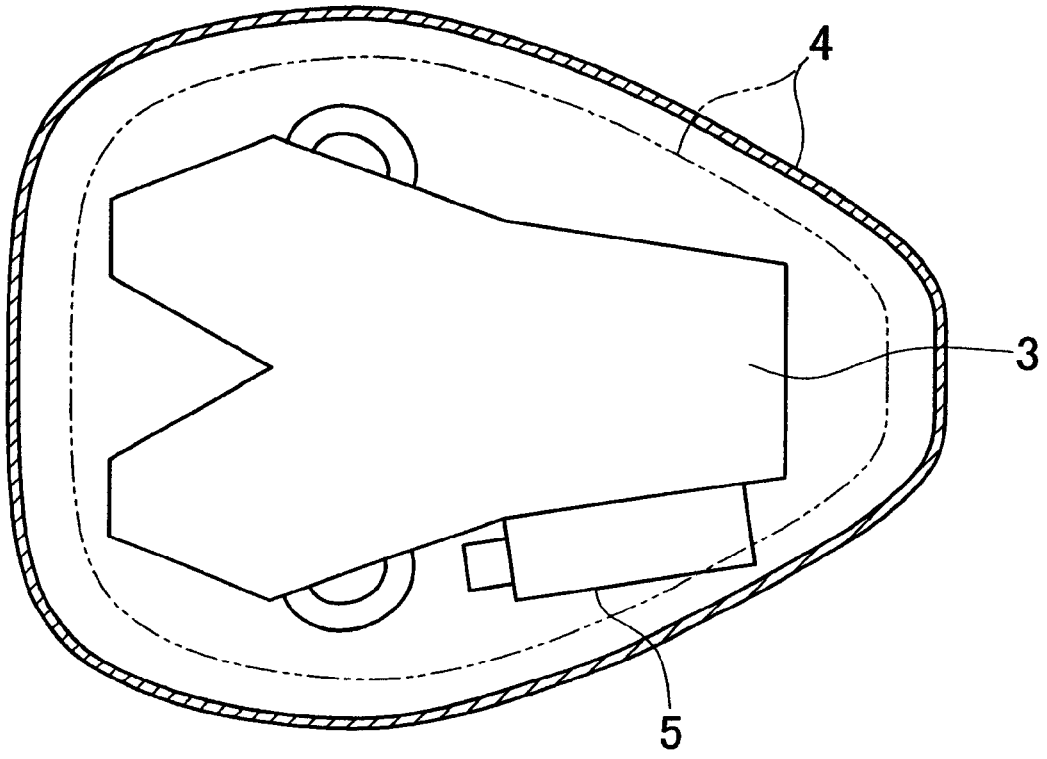
FIG. 7 is a cross-sectional view taken on line A—A in FIG. 6 of a conventional example.

Moreover, in the state of setting circuit board 13 into case 9, opening 90 opens upward as shown in FIG. 4, and resin 17 for waterproofing is filled in case 9 as shown by hatching in FIG. 5, and as a result, outboard motor electronic part unit 8 is produced.

According to the above embodiment, outboard motor electronic part unit 8 is formed into a tapered shape having a planar cross section. Furthermore, since outboard motor electronic part unit 8 is provided in space 7 having a tapered shape having a planar cross section formed between engine 3 and case 9, and is fixed to engine 3 by each bracket 95, interference between cover 6 for covering engine 3 and case 9 of outboard motor electronic part unit 8, in particular, interference at a rear portion side is prevented. Therefore, outboard motor electronic part unit 8 can be mounted at any desired place without limitation.

Among parts mounted on circuit board 13 of outboard motor electronic part unit 8, connectors 10, 11, and 12, and discrete parts 15 and 16 having a relatively large height are provided on circuit board 13 so as to correspond to the opening 90 side of case 9 which is corresponding to the large cross-sectional area portion of space 7, and other parts having a relatively small height are provided on circuit board 13 so as to correspond to the small cross-sectional area portion of space 7. Conventionally, case 9 is formed into a rectangular parallelepiped; however, in the present invention, case 9 is molded into a tapered shape which favors being provided in space 7, so that outboard motor electronic part unit 8 can be small and lightened. Therefore, cover 6 can be small and outboard motor 1 can also be small.

Furthermore, since outboard motor electronic part unit 8 is formed into a tapered shape, in comparison with unit 8 formed into a rectangular parallelepiped, volume of case 9 decreases and then a required amount of resin to be filled decreases. As a result, manufacturing cost decreases, weight of parts decreases, and also fuel consumption is improved.

Moreover, since a cross-sectional area of case 9 increases toward opening 90, when case 9 is filled with resin 17, as filling is nearly completed, the liquid surface rise rate of resin 17 decreases. Therefore, resin 17 can be filled to a predetermined position of the lower portion of opening 90 without loss.

If case 9 is a rectangular parallelepiped and has a uniform cross-sectional area conventionally, in comparison with the above-described, since resin 17 to be filled has a large liquid surface rise rate, and it is difficult to stop filling resin 17 just under opening 90. Therefore, resin 17 must be filled into case 9 up to overflow.

On the other hand, in this embodiment of the present invention, since the liquid surface rise rate of resin 17 filled during the completion is low, it is easy to time the stopping of the filling of the resin 17. Therefore, supplying resin 17 can be stopped before resin 17 overflows. As a result, excess overflowing resin 17 is not required. Since the volume of case 9 decreases, the amount of resin to be used can be remarkably decreased.

Additionally, the present invention is not limited to the above-described embodiment, and for example, any discrete parts can be used as long as the discrete parts have a relatively large height other than power transistor, the power zener diode, or condenser.

Furthermore, in this embodiment, the upper surface 93 of case 9 is composed of inclined surface 93*a* and planar surface 93*b*; however, the upper surface may be composed of only inclined surface 93*a* without planar surface 93*b*.

Optionally, outboard motor electronic part unit 8 may be equipped on cover 6.

What is claimed is:

1. An outboard motor electronic part unit provided between an engine for a boat and a cover covering the engine, comprising:

a case which is attached to the engine or the cover and is provided along a space formed between the engine and the cover; and a circuit board equipped with a connector which is housed and fixed in the case, wherein an inclined surface in which a height thereof is large near the connector and small near a distal portion far from the connector, is provided in the case.

2. An outboard motor electronic part unit according to claim 1, wherein the circuit board is mounted with parts having large height among circuit parts near the connector and with parts having small height among circuit parts near the distal portion far from the connector, so as to be housed in the case having the inclined surface.

* * * * *